US010617902B2

(12) United States Patent
Zhang et al.

(10) Patent No.: US 10,617,902 B2
(45) **Date of Patent: *Apr. 14, 2020**

(54) JUMP ROPE HANDLES INCLUDING SYSTEMS AND METHODS THEREOF

(71) Applicant: Web Guidz, LLC, Wenatchee, WA (US)

(72) Inventors: Neng wen Zhang, Dongguan (CN); Matthew Thomas Hopkins, Leavenworth, WA (US)

(73) Assignee: Web Guidz, LLC, Wenatchee, WA (US)

( * ) Notice: Subject to any disclaimer, the term of this patent is extended or adjusted under 35 U.S.C. 154(b) by 85 days.

This patent is subject to a terminal disclaimer.

(21) Appl. No.: 16/009,695

(22) Filed: Jun. 15, 2018

(65) Prior Publication Data

US 2019/0160319 A1 May 30, 2019

Related U.S. Application Data

(63) Continuation-in-part of application No. 15/823,352, filed on Nov. 27, 2017, now Pat. No. 10,556,147.

(51) Int. Cl.
*A63B 5/20* (2006.01)
*A63B 21/00* (2006.01)

(52) U.S. Cl.
CPC ..... *A63B 5/20* (2013.01); *A63B 21/4035* (2015.10); *A63B 2225/09* (2013.01)

(58) Field of Classification Search
CPC .. A63B 5/00; A63B 5/20; A63B 5/205; A63B 5/22; A63B 21/0004; A63B 21/00043; A63B 21/00058; A63B 21/00069; A63B 21/00072; A63B 21/00185; A63B 21/068; A63B 21/15; A63B 21/151; A63B 21/152; A63B 21/22;
(Continued)

(56) References Cited

U.S. PATENT DOCUMENTS 4,330,118 A * 5/1982 Race ..... A63B 5/20 482/82
4,778,173 A * 10/1988 Joutras ..... A63B 5/20 482/108

(Continued)

OTHER PUBLICATIONS

Amazon.com: SNODE T18 Self-Locking Crossfit Jump Rope-High Speed Skipping Rope-Light Weighted Speed Rope Ball Bearing &Anti-Skip Silicon Handle Grips with 2 Speed Rope Cables for Fitness Sports Training Workout: Sports & Outdoors. https://www.amazon.com/SNODE-Self-Locking-Crossfil-Rope-Light-Anti-Skip/dp/B07SXH7HW8/ef=zg_bs_3407981_68? _encoding=UTF8 &psc=1 &refRID=S9SHV2ES049JC5WNDH0K. Accessed Nov. 10, 2019.

(Continued)

*Primary Examiner* — Gary D Urbiel Goldner
(74) *Attorney, Agent, or Firm* — Jaffery Watson Mendonsa & Hamilton LLP

(57) ABSTRACT

A jump rope handle configured to hold an end portion of a jump rope is provided in accordance with some embodiments. The jump rope handle may be configured for adjustable axial or side connection of a jump rope, or both. In an embodiment, the jump rope handle includes a spindle assembly and a clamp assembly threadably joined to a distal end portion of the spindle assembly to drive a clamping force on a jump rope.

20 Claims, 5 Drawing Sheets

(58) Field of Classification Search
CPC ..... A63B 21/4027; A63B 21/4033; A63B 21/4035; A63B 21/4041; A63B 21/4043; A63B 21/4045; A63B 21/4047; A63B 21/4049; A63B 2208/0204; A63B 2208/0209; A63B 2225/09; A63B 2225/093
See application file for complete search history.

(56) References Cited

U.S. PATENT DOCUMENTS

| | | | | |
|---|---|---|---|---|
| 4,869,492 | A * | 9/1989 | Joutras | A63B 5/20 482/44 |
| 5,236,405 | A * | 8/1993 | Dohmann | A63B 5/20 482/81 |
| 5,478,297 | A * | 12/1995 | Dennis, Jr. | A63B 5/20 482/81 |
| 8,684,892 | B1 | 4/2014 | Ihli et al. | |
| 2015/0335931 | A1 | 11/2015 | Jordan et al. | |
| 2018/0361187 | A1 | 12/2018 | Hopkins et al. | |
| 2019/0111294 | A1 | 4/2019 | Yu | |
| 2019/0160319 | A1 | 5/2019 | Zhang et al. | |
| 2019/0160326 | A1 * | 5/2019 | Zhang | A63B 5/20 |

OTHER PUBLICATIONS

Youtube.com: Bullet Jump Rope Unboxing (Fidget Spinner Jump Rope), 4:29-4:47. https://www.youtube.com/watch?v=LxYyF3k6Pwl. Published Feb. 25, 2018.

Youtube.com: Bullet Rope—Cable Replacement & Sizing Demonstration. https://www.youtube.com/watch?v=C8crT_6pk7s. Published Apr. 13, 2018.

* cited by examiner

JUMP ROPE HANDLES INCLUDING SYSTEMS AND METHODS THEREOF

RELATED APPLICATIONS

This application is a continuation-in-part of co-pending U.S. application Ser. No. 15/823,352 filed Nov. 27, 2017, which is incorporated herein by reference.

BACKGROUND

Field

Embodiments related to jump ropes are disclosed. More particularly, embodiments related to jump ropes having rotatable components are disclosed.

Background Information

Jump ropes are used for play, exercise, training, and sport. A typical jump rope has a pair of jump rope handles connected by a length of rope, the swinging of which rope a user controls by the handles. The length of the rope connecting the jump rope handles is often not adjustable in a typical jump rope. For those jump ropes offering an adjustable length of rope, the length of the rope is often only downwardly adjustable such as by cutting the rope, which irreversibly shortens the rope. Furthermore, mechanisms for connecting such shortened lengths of rope to the jump rope handles are often cumbersome requiring tools and time. Provided herein are jump rope handles including systems and methods thereof that address the foregoing.

SUMMARY

Provided herein is a jump rope handle including, in some embodiments, a spindle assembly, a clamp assembly, and a clamp driving mechanism between the spindle assembly and the clamp assembly. The spindle assembly includes a shaft coupled to one or more bearings. The clamp assembly is rotatably coupled to a distal end portion of the spindle assembly, and the clamp assembly includes a set of jaws. The clamp driving mechanism is configured to open and close the set of jaws.

In some embodiments, the jump rope handle further includes a lumen. The lumen extends from a distal end of the clamp assembly, through the distal end portion of the spindle assembly, and to a proximal end portion of the spindle assembly. The lumen is configured to accommodate an end portion of a jump rope.

In some embodiments, the lumen extends through the shaft and at least one bearing of the one or more bearings.

In some embodiments, the shaft is coupled to two rolling-element bearings. A first bearing of the two bearings is around a distal end portion of the shaft, while a second bearing of the two bearings is around a proximal end portion of the shaft.

In some embodiments, the spindle assembly further includes a doubly threaded fastener and a collar. The fastener is in a distal end portion of the shaft, and the collar is around a distal end portion of the fastener.

In some embodiments, the clamp assembly further includes a drive piece disposed in a body of the clamp assembly. A base piece forms the body of the clamp assembly with a clamp hood, and the drive piece is between the set of jaws and the base piece.

In some embodiments, the clamp driving mechanism includes a doubly threaded fastener in a distal end portion of the shaft, a collar around a distal end portion of the fastener, a drive piece disposed in a body of the clamp assembly, and a base piece forming the body of the clamp assembly with a clamp hood.

In some embodiments, the clamp driving mechanism is configured to close the set of jaws upon holding the spindle assembly stationary by the collar and screwing the clamp assembly onto the fastener. Holding the spindle assembly stationary and screwing the clamp assembly onto the fastener drives a distal end of the fastener through a threaded bore of the base piece and into the drive piece. The distal end of the fastener pushes the drive piece and, thus, the set of jaws along a tapered bore of the clamp hood toward a distal end of the clamp assembly.

In some embodiments, the jump rope handle further includes a housing assembly rotatably coupled to the spindle assembly. The housing assembly includes a spindle housing, a grip over the spindle housing, and a flared end piece in a proximal end portion of the spindle housing. The spindle housing is configured to accommodate at least a portion of the spindle assembly.

Also provided herein is a jump rope handle including, in some embodiments, a spindle assembly, a clamp assembly, a lumen through the spindle assembly and the clamp assembly, and a clamp driving mechanism between the spindle assembly and the clamp assembly. The spindle assembly includes a shaft coupled to two ball bearings. A first bearing of the two bearings is around a distal end portion of the shaft. A second bearing of the two bearings is around a proximal end portion of the shaft. The spindle assembly also includes a doubly threaded fastener in the distal end portion of the shaft, and a collar around a distal end portion of the fastener. The clamp assembly is rotatably coupled to a distal end portion of the spindle assembly. The clamp assembly includes a drive piece disposed in a body of the clamp assembly. A base piece forms the body of the clamp assembly with a clamp hood, and the drive piece is between a set of jaws and the base piece. The lumen extends from a distal end of the clamp assembly, through the distal end portion of the spindle assembly, and to a proximal end portion of the spindle assembly. The clamp driving mechanism is configured to close the set of jaws around an end portion of a jump rope disposed in the lumen up to the proximal end portion of the spindle assembly.

In some embodiments, the clamp driving mechanism includes the fastener and the collar of the spindle assembly and the drive piece and the base piece of the clamp assembly.

In some embodiments, the clamp driving mechanism is configured to close the set of jaws upon holding the spindle assembly stationary by the collar and screwing the clamp assembly onto the fastener. Holding the spindle assembly stationary and screwing the clamp assembly onto the fastener drives a distal end of the fastener through a threaded bore of the base piece and into the drive piece. The distal end of the fastener pushes the drive piece and, thus, the set of jaws along a tapered bore of the clamp hood toward a distal end of the clamp assembly.

In some embodiments, the jump rope handle further includes a housing assembly including a spindle housing rotatably coupled to the spindle assembly. The housing assembly further includes a grip over the spindle housing, and a flared end piece in a proximal end portion of the spindle housing. The housing assembly is configured to accommodate the spindle assembly excepting the collar around the distal end portion of the fastener.

Also provided herein is a jump rope system including, in some embodiments, a jump rope and a jump rope handle configured to hold an end portion of the jump rope. The jump rope handle includes a spindle assembly, a clamp assembly, a lumen through the spindle assembly and the clamp assembly, and a clamp driving mechanism between the spindle assembly and the clamp assembly. The spindle assembly includes a shaft coupled to one or more bearings. The clamp assembly is rotatably coupled to a distal end portion of the spindle assembly, and the clamp assembly includes a set of jaws. The lumen extends from a distal end of the clamp assembly to a proximal end portion of the spindle assembly. The clamp driving mechanism is configured to open and close the set of jaws such as close the set of jaws around the end portion of the jump rope disposed in the lumen up to the proximal end portion of the spindle assembly.

In some embodiments, the lumen extends through the shaft and at least a first bearing of two rolling-element bearings. The first bearing of the two bearings is around a distal end portion of the shaft, while a second bearing of the two bearings is around a proximal end portion of the shaft.

In some embodiments, wherein the lumen is configured to accommodate a length of the end portion of the jump rope ranging from about 10 cm to about 20 cm. The lumen is also configured to accommodate a diameter of the jump rope ranging from about 1 mm to about 6 mm.

In some embodiments, the spindle assembly further includes a doubly threaded fastener and a collar. The fastener is in a distal end portion of the shaft, and the collar is around a distal end portion of the fastener.

In some embodiments, the clamp assembly further includes a drive piece disposed in a body of the clamp assembly. A base piece forms the body of the clamp assembly with a clamp hood, and the drive piece is between the set of jaws and the base piece.

In some embodiments, the clamp driving mechanism includes the fastener and the collar of the spindle assembly and the drive piece and the base piece of the clamp assembly.

In some embodiments, the clamp driving mechanism is configured to close the set of jaws upon holding the spindle assembly stationary by the collar and screwing the clamp assembly onto the fastener. Holding the spindle assembly stationary and screwing the clamp assembly onto the fastener drives a distal end of the fastener through a threaded bore of the base piece and into the drive piece. The distal end of the fastener pushes the drive piece and, thus, the set of jaws along a tapered bore of the clamp hood toward the distal end of the clamp assembly.

In some embodiments, the jump rope handle further includes a housing assembly including a spindle housing configured to accommodate at least a portion of the spindle assembly. The housing assembly further includes a grip over the spindle housing, and a flared end piece in a proximal end portion of the spindle housing. The housing assembly is rotatably coupled to the spindle assembly.

In some embodiments, a jump rope handle includes a spindle assembly including a shaft coupled to one or more bearings, and a clamp assembly threadably joined to a distal end portion of the spindle assembly. The clamp assembly may include a clamp hood, a drive piece that is axially translatable within the clamp hood, and a base piece. The base piece may be threadably connected to the distal end portion of the spindle assembly such that threading the clamp assembly toward the spindle assembly causes the distal end of the spindle assembly to drive the drive piece toward a distal end of the clamp assembly.

In some embodiments, a jump rope handle additionally includes a spindle housing around the shaft and the one or more bearings, where an outer race for each of the one or more bearings is joined to an interior diameter of the spindle housing, and the shaft is joined to an inner race for each of the one or more bearings such that the shaft is rotatable relative to the spindle housing. The base piece may be threadably fixed to the clamp hood.

In some embodiments, the spindle assembly includes a fastener joined to a distal end of the shaft, where the base piece is threadably joined to the fastener such that threading the fastener into the base piece drives the drive piece toward the distal end of the clamp assembly.

A collar may be fixed onto the fastener, such that rotation of the collar causes rotation of the shaft. In some embodiments, a spindle housing is around the spindle assembly and the one or more bearings, and the shaft is rotatable relative to the spindle housing.

In some embodiments, the collar is fixed onto the faster with a gap between a proximal end of the collar and a distal end of the spindle housing. The collar may include a textured outer surface. In some embodiments, rotation of the collar and clamp hood in opposite rotational directions with regard to each other causes axial translation of the fastener within the base piece.

In some embodiments, a pair of laterally opposite holes are included in the clamp hood, with the pair of laterally opposite holes configured to accommodate a jump rope. In some embodiments, the fastener is axially translatable within the base piece to drive a distal face of the drive piece from a location proximal to the pair of laterally opposite holes to a location laterally adjacent to the pair of laterally opposite holes. In some embodiments, the clamp assembly further includes a set of jaws within the clamp hood distal to the drive piece. In such embodiments, the fastener may be axially translatable within the base piece to cause the drive piece to drive a distal portion of the jaws from a location proximal to the pair of laterally opposite holes to a location laterally adjacent to the pair of laterally opposite holes. For example, the set of jaws may be translatable along a tapered bore of the clamp hood, such that the set of jaws closes as the set of jaws is translated distally along the tapered bore of the clamp hood. In such embodiments, a lumen may also extend from a distal end of the clamp assembly, through a distal end of the spindle assembly, with the lumen configured to accommodate an end portion of a jump rope.

In some embodiments, a jump rope system includes a jump rope and a pair of jump rope handles. Each jump rope handle may include a spindle assembly including a shaft coupled to one or more bearings, and a clamp assembly threadably joined to a distal end portion of the spindle assembly. The clamp assembly may include a clamp hood, a drive piece that is axially translatable within the clamp hood, and a base piece. The base piece may be threadably connected to the distal end portion of the spindle assembly such that threading the clamp assembly toward the spindle assembly causes the distal end of the spindle assembly to drive the drive piece toward a distal end of the clamp assembly.

A pair of laterally opposite holes may be included in the clamp hood, with the pair of laterally opposite holes configured to accommodate the jump rope.

In some embodiments, the distal end portion of the spindle assembly is axially translatable within the base piece to drive a distal face of the drive piece from a location proximal to the pair of laterally opposite holes to a location laterally adjacent to the pair of laterally opposite holes to secure a length of the jump rope within the clamp assembly.

In some embodiments, the clamp assembly further includes a set of jaws within the clamp hood distal to the drive piece. The distal end portion of the spindle assembly may be axially translatable within the base piece to cause the drive piece to drive a distal portion of the jaws from a location proximal to the pair of laterally opposite holes to a location laterally adjacent to the pair of laterally opposite holes to secure a length of the jump rope within the clamp assembly. A lumen may additionally extend from a distal end of the clamp assembly, through a distal end of the spindle assembly, with the lumen also configured to accommodate an end portion of the jump rope.

DETAILED DESCRIPTION

Figure 1:
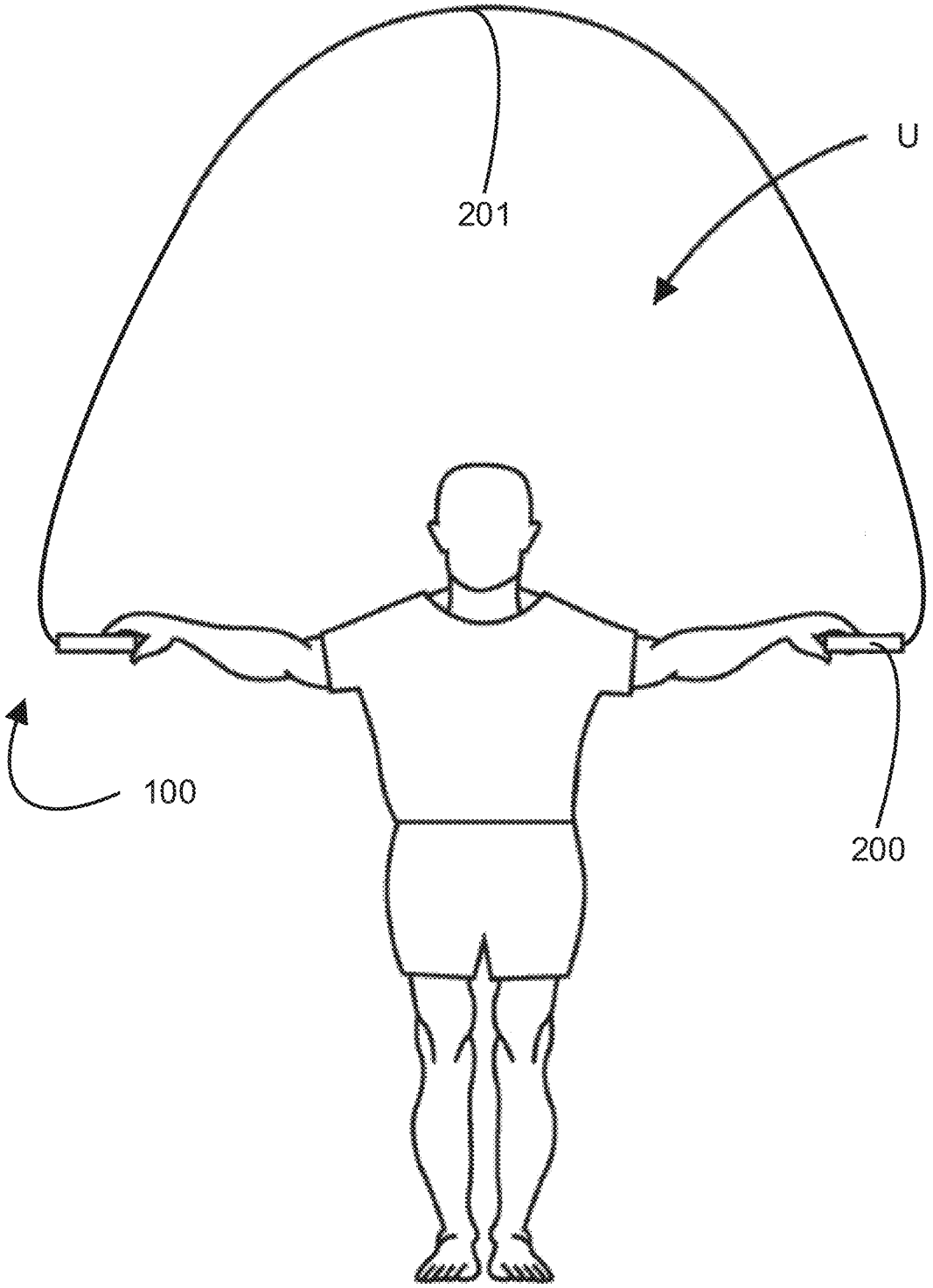
FIG. 1 provides a schematic illustrating a user with a jump rope system in accordance with some embodiments.

Before some particular embodiments are provided in greater detail, it should be understood that the particular embodiments provided herein do not limit the scope of the concepts provided herein. It should also be understood that a particular embodiment provided herein can have features that can be readily separated from the particular embodiment and optionally combined with or substituted for features of any of a number of other embodiments provided herein.

Regarding terms used herein, it should also be understood the terms are for the purpose of describing some particular embodiments, and the terms do not limit the scope of the concepts provided herein. Ordinal numbers (e.g., first, second, third, etc.) are generally used to distinguish or identify different features or steps in a group of features or steps, and do not supply a serial or numerical limitation. For example, "first," "second," and "third" features or steps need not necessarily appear in that order, and the particular embodiments including such features or steps need not necessarily be limited to the three features or steps. Labels such as "proximal," "distal," and the like are used for convenience and are not intended to imply, for example, any particular fixed location, orientation, or direction. Instead, such labels are used to reflect, for example, relative location, orientation, or directions. Singular forms of "a," "an," and "the" include plural references unless the context clearly dictates otherwise.

With respect to "proximal," a "proximal portion" or a "proximal end portion" of, for example, a jump rope handle provided herein includes a portion of the handle nearest a user or directed toward the user when the handle is held and used as intended. (See, for example, FIG. 1.) Likewise, a "proximal length" of, for example, the handle includes a length of the handle nearest the user or directed toward the user when the handle is held and used as intended. A "proximal end" of, for example, the handle includes an end of the handle nearest the user or directed toward the user when the handle is held and used as intended. The proximal portion, the proximal end portion, or the proximal length of the handle can include the proximal end of the handle; however, the proximal portion, the proximal end portion, or the proximal length of the handle need not include the proximal end of the handle. That is, unless context suggests otherwise, the proximal portion, the proximal end portion, or the proximal length of the handle is not a terminal portion or terminal length of the handle.

With respect to "distal," a "distal portion" or a "distal end portion" of, for example, a jump rope handle provided herein includes a portion of the handle farthest from a user or directed away from the user when the handle is held and used as intended. (See, for example, FIG. 1.) Likewise, a "distal length" of, for example, the handle includes a length of the handle farthest from the user or directed away from the user when the handle is held and used as intended. A "distal end" of, for example, the handle includes an end of the handle farthest from the user or directed away from the user when the handle is held and used as intended. The distal portion, the distal end portion, or the distal length of the handle can include the distal end of the handle; however, the distal portion, the distal end portion, or the distal length of the handle need not include the distal end of the handle. That is, unless context suggests otherwise, the distal portion, the distal end portion, or the distal length of the handle is not a terminal portion or terminal length of the handle.

Unless defined otherwise, all technical and scientific terms used herein have the same meaning as commonly understood by those of ordinary skill in the art.

As set forth herein above, a typical jump rope has a pair of jump rope handles connected by a length of rope, the swinging of which rope a user controls by the handles. The length of the rope connecting the jump rope handles is often not adjustable in a typical jump rope. For those jump ropes offering an adjustable length of rope, the length of the rope is often only downwardly adjustable such as by cutting the rope, which irreversibly shortens the rope. Furthermore, mechanisms for connecting such shortened lengths of rope to the jump rope handles are often cumbersome requiring tools and time. Provided herein are jump rope handles including systems and methods thereof that address the foregoing. In some embodiments, the jump rope handles are configured for an adjustable axial jump rope connection. In some embodiments, the jump rope handles are configured for an adjustable side jump rope connection. In some embodiments, the jump rope handles are configured for both an adjustable axial jump rope connection and adjustable side jump rope connection.

In accordance with some embodiments, a jump rope handle is configured to hold an end portion of a jump rope. In accordance with embodiments, the jump rope handle includes a spindle assembly, and a clamp assembly. In some configurations the clamp assembly may resemble a chuck assembly configured for radial clamping of the rope. In some embodiments, the term "clamp'" in clamp assembly, clamp hood, clamp driving mechanism may be understood as a "chuck." Other configurations describe modifications to such a chuck assembly which may or may not be configured for radial clamping, though mechanically the jump rope handles share many similarities. Thus, the clamp assemblies may be understood as modified chuck assemblies in some embodiments. For example, the clamp assembly may be configured for orthogonal clamping, where a drive piece presses orthogonally against a rope spanning between two holes in the clamp assembly.

In an embodiment configured for an adjustable axial jump rope connection, a lumen extends through the spindle assembly and the clamp assembly, and a clamp driving mechanism between the spindle assembly and the clamp assembly, which clamp driving mechanism can be toolless or keyless. The spindle assembly includes a shaft coupled to one or more bearings. The clamp assembly is rotatably coupled to a distal end portion of the spindle assembly. The lumen may extend along a longitudinal axis of the handle from a distal end of the clamp assembly to a proximal end portion of the spindle assembly, though the lumen may terminal at a medial location in the handle. The clamp driving mechanism is configured to axially translate (through a longitudinal axis of the handle) a drive piece into a clamp hood toward a distal end of the clamp assembly. In some embodiments, the drive piece causes a set of jaws to open and close a set of jaws around the end portion of the jump rope disposed in the lumen, a length of which end portion of the jump rope can be adjusted up to the proximal end portion of the spindle assembly to match a full length of the lumen. This obviates having to cut the jump rope. A jump rope system including a jump rope and a pair of such jump rope handles is also provided in accordance with some embodiments. In some embodiments, the clamp assembly includes a pair of openings for adjustable side jump rope connection, which can also obviate having to cut the jump rope. The pair of openings may be included in the clamp assembly either with, or without, the set of jaws.

FIG. 1 provides a schematic illustrating a user U with a jump rope system 100, or jump rope 100, in accordance with some embodiments. As shown, the jump rope system 100 includes a pair of jump rope handles connected by a jump rope 201. One jump rope handle of the pair of jump rope handles is designated as handle 200 in FIGS. 1-3.

Figure 2:
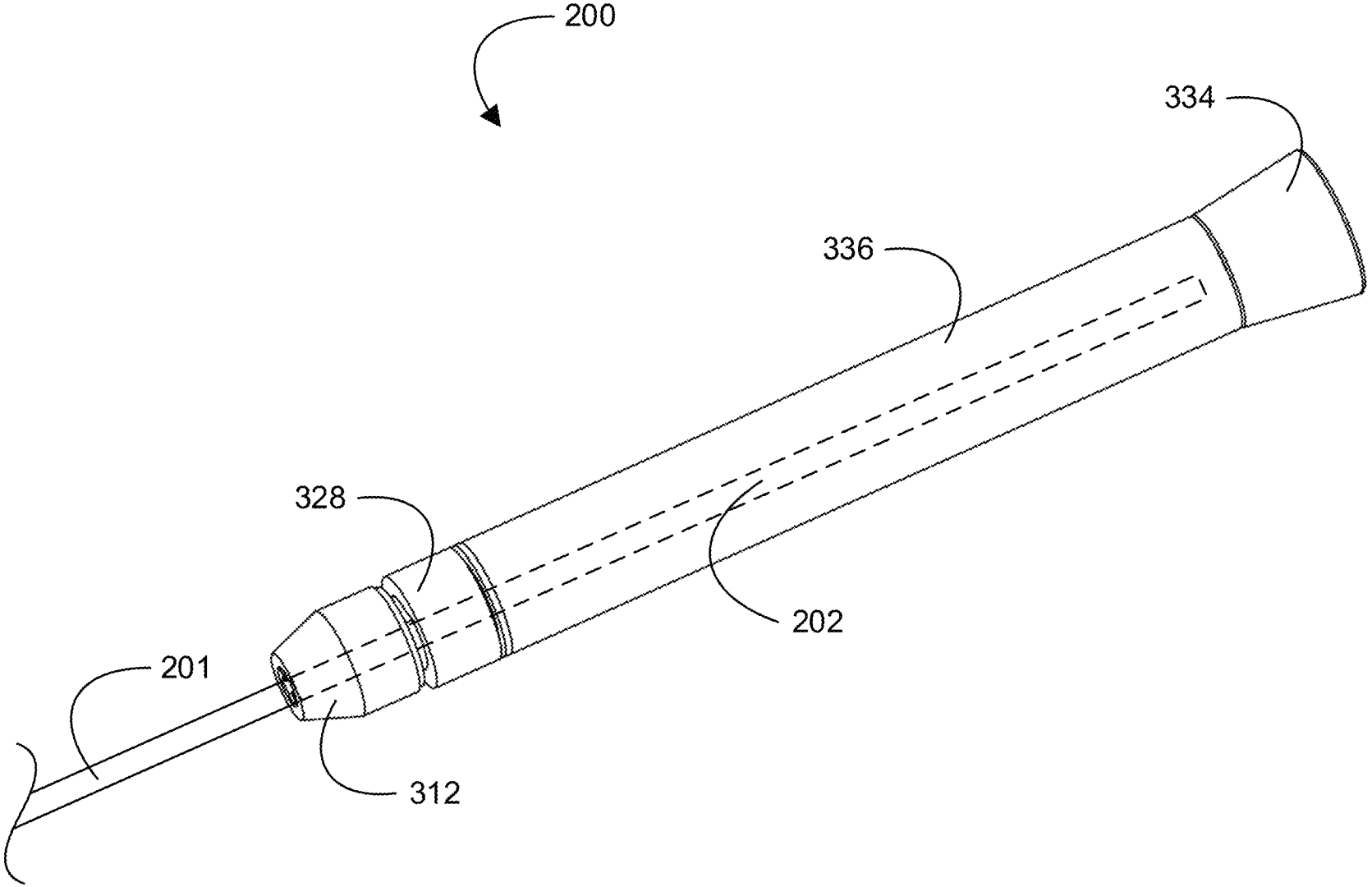
FIG. 2 provides a schematic illustrating a handle of a jump rope system for an adjustable axial rope connection in accordance with some embodiments.
Figure 3:
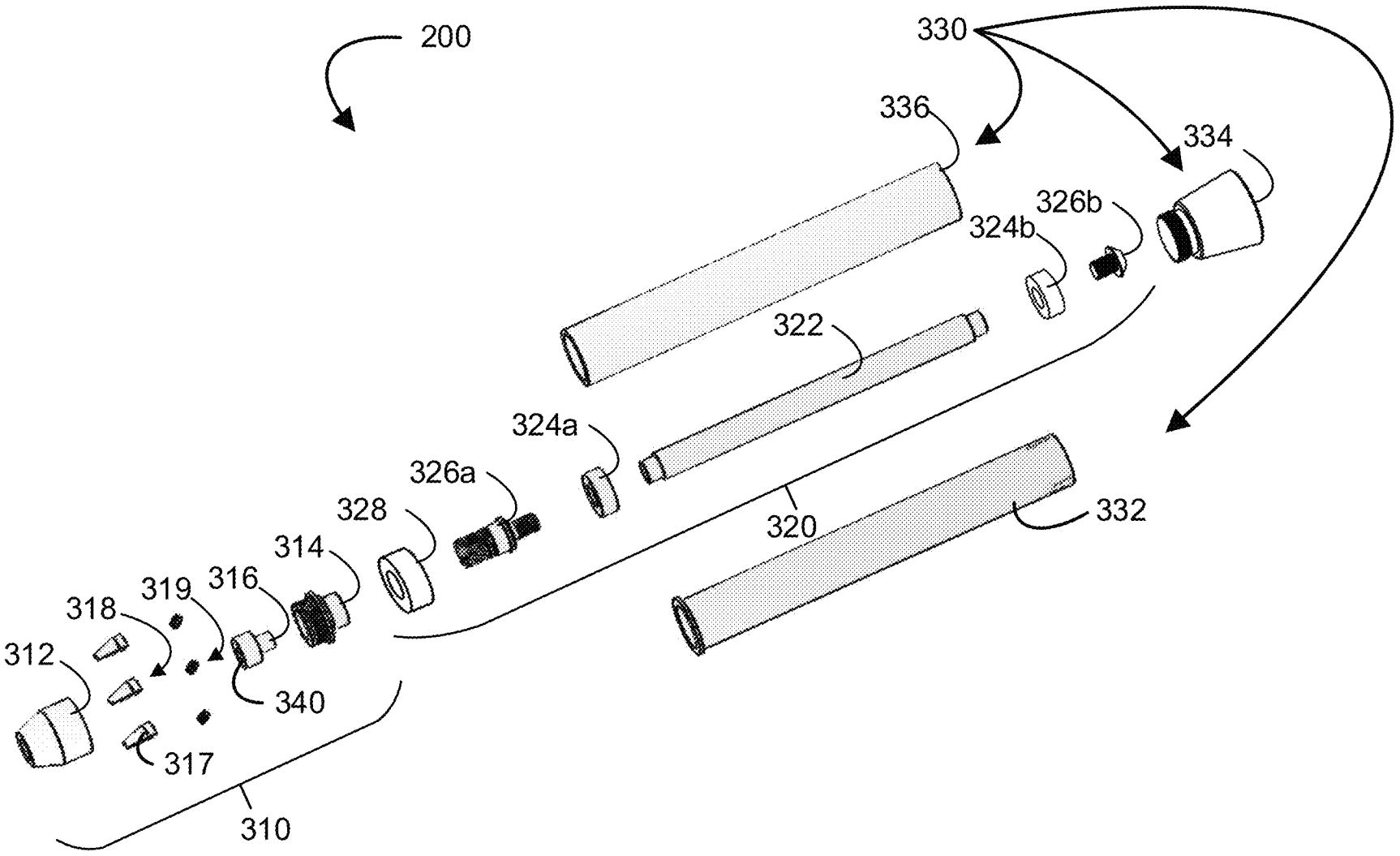
FIG. 3 provides a schematic illustrating an exploded view of the handle of FIG. 2.

FIG. 2 provides a schematic illustrating the jump rope handle 200 of the jump rope system 100 in accordance with some embodiments, and FIG. 3 provides a schematic illustrating an exploded view of the handle 200 of FIG. 2. As shown, the jump rope handle 200 includes a clamp assembly 310, a spindle assembly 320, a lumen 202 through the clamp assembly 310 and the spindle assembly 320, and a housing assembly 330 around at least a portion of the spindle assembly 320.

The clamp assembly 310 includes a clamp hood 312 and a base piece 314 forming a body of the clamp assembly 310. An inner perimeter of the clamp hood 312 and an outer perimeter of the base piece 314 are mutually threaded for screwing the clamp hood 312 and the base piece 314 together to form the body of the clamp assembly 310. In operation, these may be threadably fixed in place, and not adjusted by the user. An inner perimeter of the base piece 314 is also threaded providing a threaded bore or through hole of the base piece 314 for mounting the clamp assembly 310 on the spindle assembly 320 and participating in the clamp driving mechanism.

Within the body of the clamp assembly 310 is a drive piece 316, a set of optional jaws 318 (e.g., a 2-, 3-, 4-, 5-, or 6-jawed set of jaws 318), and a set of springs 319. While separate jaws 318 and springs are illustrated, embodiments are not so limited. For example, the jaws 318 may be connected in a pin-type arrangement (e.g. with through hole to provide lumen 202). The drive piece 316 is disposed between the set of jaws 318 and the base piece 314, the drive piece 316 supporting the set of jaws 318 at a base thereof. In an embodiment, a proximal portion of the drive piece 316 freely extends or translates within an inside diameter of the proximal portion of base piece 314 where it may interface with a distal end of first fastener 326*a*, causing the drive piece 316 to translate axially within the clamp hood 312. When jaws 318 are present, the distal face 340 of drive piece 316 (with larger diameter than the proximal portion of the drive piece 316) may drive the jaws 318 toward the distal end of the clamp hood 312. The inner perimeter of the clamp hood 312 distal of any threading is tapered providing a tapered bore of the clamp hood 312, against which tapered bore the set of jaws 318 are held with an outwardly directed radial force provided by the set of springs 319. Each jaw of the set of jaws 318 is held apart from an adjacent jaw by an intervening compression spring of the set of springs 319, thereby providing the outwardly directed radial force that holds the set of jaws 318 apart and against the tapered bore of the clamp hood 312. As an increasing load is applied to the set of springs 319, such as by closing the set of jaws 318 by way of the clamp driving mechanism, each spring of the set of springs 319 compresses and shortens under the increasing load allowing adjacent jaws of the set of jaws 318 to approach to each other. A tool or key is not needed to close the set of jaws 318 of the clamp assembly 310; that is, the clamp assembly 310 can be toolless or keyless as shown in FIGS. 2 and 3.

In some embodiments, the clamp assembly 310 is configured as a collet clamp assembly including a tapered receiving sleeve, a collet proper configured to insert into the receiving sleeve, and a collar configured to hold the collet proper in the receiving sleeve such as by friction or screwing the collar over the receiving sleeve including the collet proper.

The spindle assembly 320 includes a shaft 322 coupled to one or more bearings such as a pair of bearings 324. The pair of bearings 324 includes a first bearing 324*a* around a distal end portion of the shaft 322 and a second bearing 324*b* around a proximal end portion of the shaft 322. Each end portion of the distal end portion and the proximal end portion of the shaft 322 includes a recessed outer perimeter having a smaller outer diameter than an outer diameter of a medial portion of the shaft 322. The smaller outer diameter matches an inner diameter of a bearing within an allowance for coupling the shaft 322 to the pair of bearings 324 with an interference fit.

Each bearing of the pair of bearings 324 can be a rolling-element bearing having rolling elements between inner and outer races, the rolling elements independently selected for each bearing from balls and rollers, the rollers including cylindrical rollers, spherical rollers, geared rollers, tapered rollers, or needle rollers. For example, each bearing of the pair of bearings 324 can be a ball bearing having balls between inner and outer races. In some embodiments, a rolling-element bearing such as a ball bearing has a small profile with dimensions including an outer diameter of 12.7 mm, an inner diameter of 6.35 mm, and a height or thickness of 4.76 mm. The small profile of each bearing of the pair of bearings 324 facilitates disposal of the spindle assembly 320 in the housing assembly 330, which housing assembly 330 is configured to comfortably fit in a user's hand.

Notwithstanding an extended length of the shaft 322 between the pair of bearings 324, coupling the shaft 322 to the pair of bearings 324 with the bearings around the end portions of the shaft 322 reduces or eliminates precession of the shaft 322 when axial loads are applied such as by swinging the rope 201 when the rope 201 is clamped in the clamp assembly 310. In combination with axial load-compensating placement of the pair of bearings 324, which also serves to reduce friction, the rolling-element bearings enable an efficient spinning of the spindle assembly 320.

Each end portion of the distal end portion and the proximal end portion of the shaft 322 also includes a threaded inner perimeter for fastening the pair of bearings 324 to the shaft 322. As shown in FIG. 3, the pair of bearings 324 are fastened to the shaft 322 with a pair of threaded fasteners 326 including a first fastener 326*a* for fastening the first bearing 324*a* around the distal end portion of the shaft 322 and a second fastener 326*b* for fastening the second bearing 324*b* around the proximal end portion of the shaft 322. The first fastener 326*a* is a doubly threaded fastener configured to screw a distal end of the first fastener 326*a* into the threaded bore or through hole of the base piece 314 for mounting the clamp assembly 310 on the spindle assembly 320 and participating in the clamp driving mechanism. A collar 328 over a distal end portion of the first fastener 326*a* is disposed between the clamp assembly 310 and the shaft 322 within the housing assembly 330. The collar 328 is set with a gap between the clamp assembly 310 and housing assembly 330 such that the collar 328 does not rub or otherwise interfere with the spinning of the spindle assembly 320. In an embodiment, collar 328 may be secured onto the larger diameter of the first fastener 326*a* with an interference fit, for example, such that a distal end of the outside threaded portion of the first fastener 326*a* extends distally past the collar 328.

As shown in FIG. 2, the lumen 202 of the jump rope handle 200 extends from a distal end of the jump rope handle 200 to a proximal end portion of the jump rope handle 200. More particularly, the lumen 202 extends from a distal end of the clamp assembly 310 to a proximal end portion of the spindle assembly 320 though it is not required to extend completely to a proximal end (e.g. shaft may have a shorter length). As such, the lumen 202 extends through a combination of i) the clamp hood 312, the optional set of jaws 318, the optional set of springs 319, the drive piece 316, and the base piece 314 of the clamp assembly 310 and ii) the first fastener 326*a*, the collar 328, and at least the first bearing 324*a* and the distal end portion of the shaft 322 of the spindle assembly. Depending upon an extent to which the second fastener 326*b* is screwed into the proximal end portion of the shaft 322, the lumen 202 can further extend through at least a portion of the second bearing 324*b* at the proximal end portion of the shaft 322. In some embodiments, the second fastener 326*b* includes a bore that extends the lumen 202 through the second bearing 324*b* to a proximal end of the shaft 322 coextensive with a head of the fastener 326*b*.

The lumen 202 is configured to accommodate an end portion of the rope 201 such as a length of the rope 201 in excess of that needed or desired by the user U (e.g., a jumper). In some embodiments, the lumen 202 has a length of at least 2 cm, 4 cm, 6 cm, 8 cm, 10 cm, 12 cm, 14 cm, 16 cm, 18 cm, or 20 cm to accommodate the end portion of the rope 201. In some embodiments, the lumen 202 has a length of no more than 20 cm, 18 cm, 16 cm, 14 cm, 12 cm, 10 cm, 8 cm, 6 cm, 4 cm, or 2 cm to accommodate the end portion of the rope 201. In some embodiments, the lumen 202 has a length of at least 2 cm to no more than 20 cm, including a length of at least 10 cm to no more than 20 cm, such as a length of at least 12 cm to no more than 18 cm, for example, a length of at least 12 cm to no more than 16 cm to accommodate the end portion of the rope 201. As such, the user U can adjust the length of rope 201 without cutting the rope 201 to provide shorter lengths for exercise or training, longer lengths for tricks during play, or an appropriate length for additional users.

The lumen 202 is also configured to accommodate any of several diameters of the end portion of the rope 201. In some embodiments, the lumen 202 has a minimum diameter of at least 1 mm, 2 mm, 3 mm, 4 mm, 5 mm, or 6 mm to accommodate the end portion of the rope 201. In some embodiments, the lumen 202 has a minimum diameter of no more than 6 mm, 5 mm, 4 mm, 3 mm, 2 mm, or 1 mm to accommodate the end portion of the rope 201. In some embodiments, the lumen 202 has a minimum diameter of at least 1 mm to no more than 6 mm, including a minimum diameter of at least 2 mm to no more than 6 mm, such as a minimum diameter at least 3 mm to no more than 6 mm, for example, a minimum diameter of at least 4 mm to no more than 6 mm to accommodate the end portion of the rope 201. As such, the user U can switch out the rope 201 to provide a thicker rope for exercise or training, a thinner rope for competition or tricks during play, or the like.

The clamp driving mechanism or clamping mechanism is between the clamp assembly 310 and the spindle assembly 320. More specifically, the clamp driving mechanism includes at least the first or doubly threaded fastener 326*a* in the distal end portion of the shaft 322, the collar 328 around the distal end portion of the doubly threaded fastener 326*a*, the drive piece 316 disposed in the body of the clamp assembly 310, and the base piece 314, which forms the body of the clamp assembly 310 with the clamp hood 312.

The clamp driving mechanism is configured to close the set of jaws 318 around the end portion of the jump rope 201, which jump rope can be disposed in the lumen 202 up to the proximal end portion of the spindle assembly 320. More specifically, the clamp driving mechanism is configured to close the set of jaws 318 upon holding the spindle assembly 320 stationary by the collar 328 and screwing the clamp assembly 310 toward or otherwise onto or further onto the doubly threaded fastener 326*a*. Holding the spindle assembly 320 stationary and screwing the clamp assembly 310 toward the doubly threaded fastener 326*a* drives a distal end of the doubly threaded fastener 326*a* or a bolt thereof through the threaded bore of the base piece 314 and into the drive piece 316. The distal end of the doubly threaded fastener 326*a* pushes the drive piece 316 and, thus, the drive piece-supported set of jaws 318 along the tapered bore of the clamp hood 312, toward the distal end of the clamp assembly 310, and out of the distal end of the clamp assembly 310 depending upon a diameter of the jump rope 201. An outer perimeter of the collar 328 and an outer perimeter of the clamp hood 312 can each be textured to facilitate holding the spindle assembly 320 stationary and screwing the clamp assembly 310 toward the doubly threaded fastener 326*a*.

The clamp driving mechanism is further configured to open the set of jaws 318 to release the end portion of the jump rope 201. More specifically, the clamp driving mechanism is configured to open the set of jaws 318 upon holding the spindle assembly 320 stationary by the collar 328 and screwing the clamp assembly 310 away from the doubly threaded fastener 326*a*. Holding the spindle assembly 320 stationary and screwing the clamp assembly 310 away from the doubly threaded fastener 326*a* pulls the distal end of the doubly threaded fastener 326*a* or the bolt thereof back through the threaded bore of the base piece 314 and away from both the drive piece 316 and the drive piece-supported set of jaws 318, thereby allowing the set of jaws 318 to relax.

The housing assembly 330 is rotatably coupled to the spindle assembly 320 and configured to accommodate at least a portion of the spindle assembly 320. The housing assembly 330 includes a spindle housing 332, a grip 336 (e.g., a foam grip, metal grip, etc.) over the spindle housing 332, and a flared end piece 334 configured to keep the user's hand from slipping off the proximal end portion of the housing assembly 330 or the jump rope handle 200. An inner perimeter of the spindle housing 332 and an outer perimeter of the end piece 334 are mutually threaded for screwing the end piece 334 and the spindle housing 332 together to form a body of the housing assembly 330.

Figure 4:
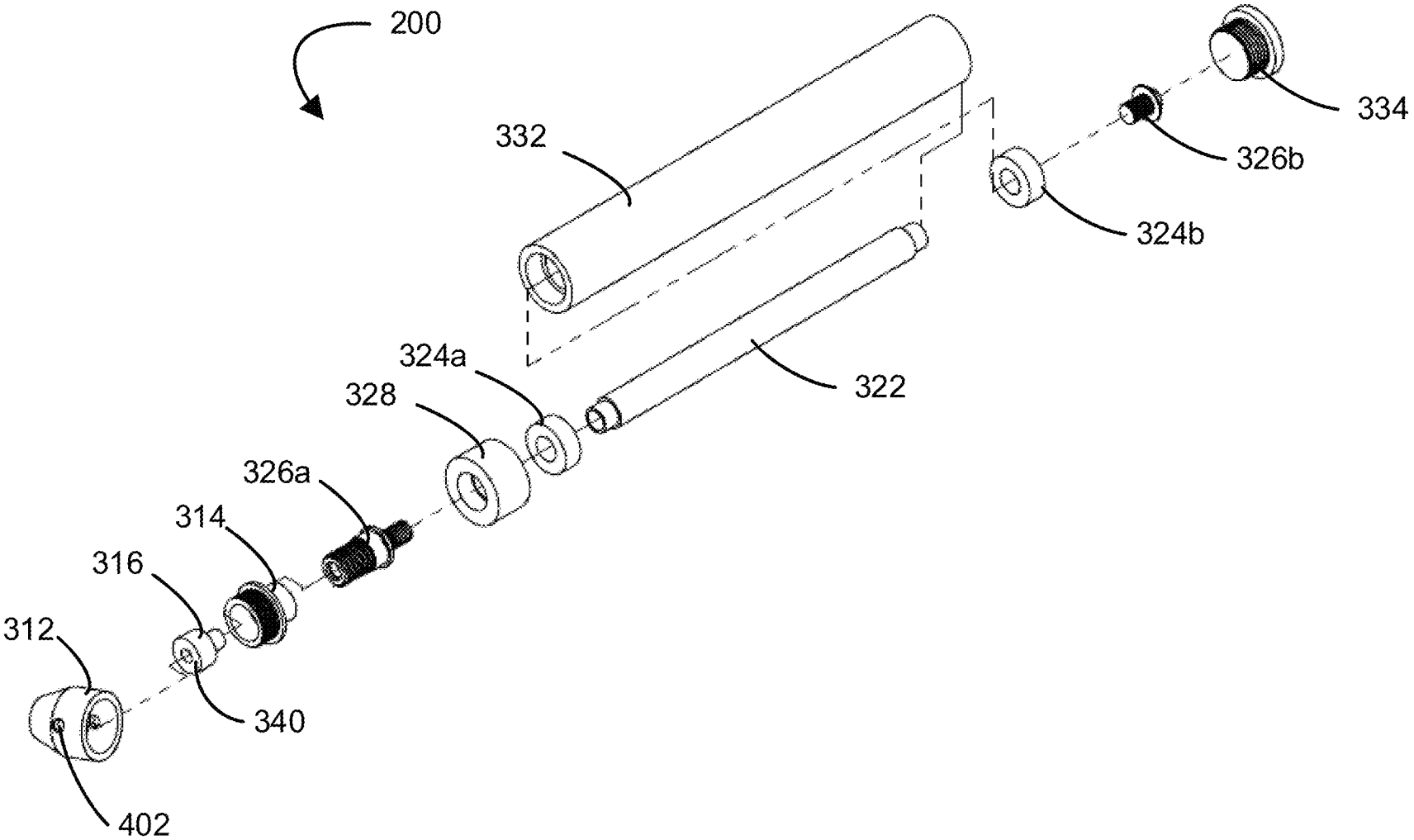
FIG. 4 provides a schematic illustrating an exploded view of a handle for a jump rope system including laterally opposite holes for an adjustable side rope connection in accordance with some embodiments.
Figure 5:
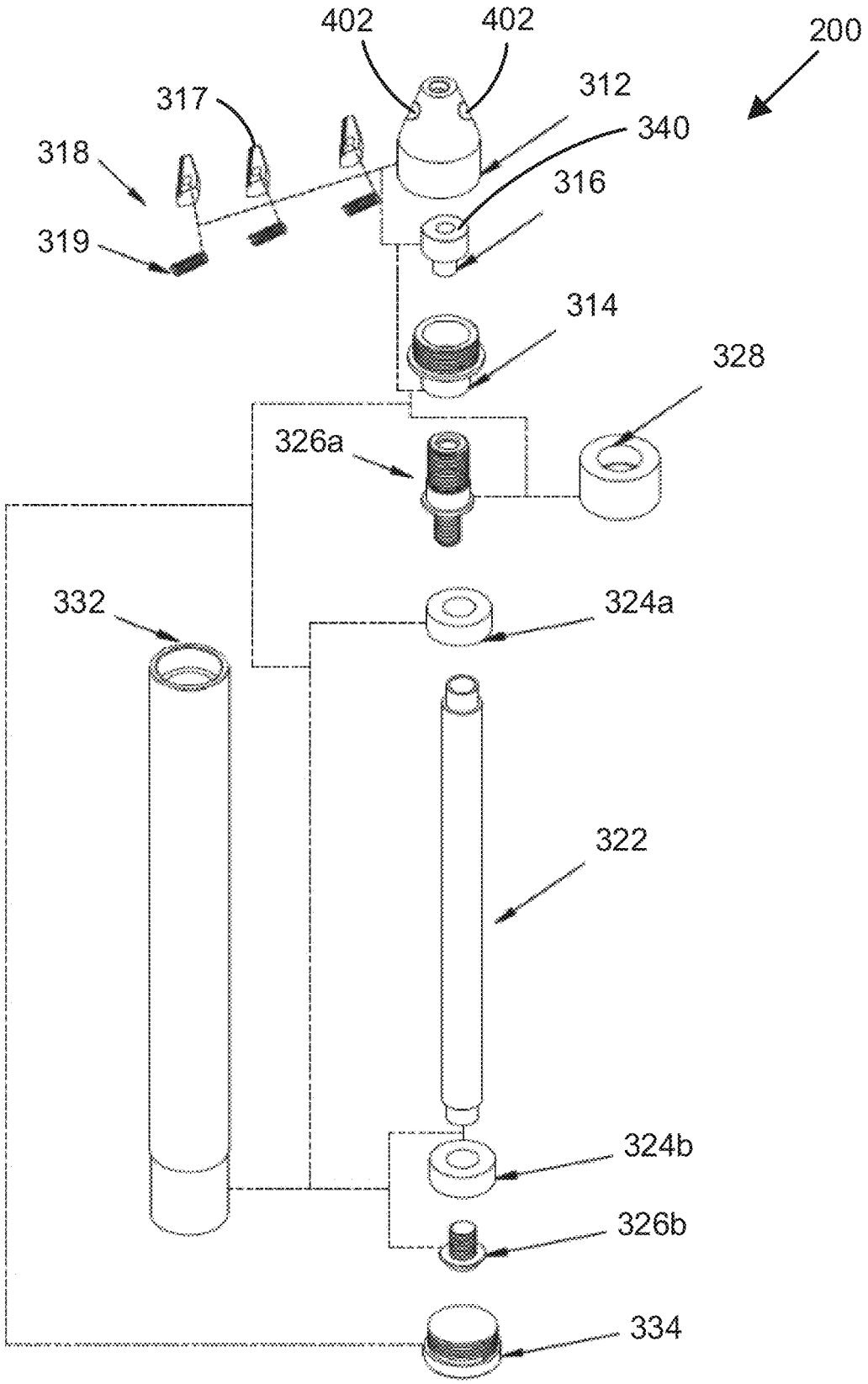
FIG. 5 provides a schematic illustrating an exploded view of a handle for a jump rope system for both adjustable axial rope connection and adjustable side rope connection in accordance with some embodiments.

Still referring to FIG. 3, along with FIGS. 4-5, jump rope handles 200 are illustrated as including a spindle assembly 320 including a shaft 322 coupled to one or more bearings 324*a*, 324*b*, and a clamp assembly 310 that is threadably joined to a distal end portion of the spindle assembly 200. Specifically, base piece 314 is threadably joined to the doubly threaded fastener 326*a*. Such a joining is not fixed in location and may be movable by the user. For example, the clamp assembly 310 may be completely removed from the spindle assembly 320 by unthreading the connection. Alternatively, the jump rope may be clamped by threading the doubly threaded fastener 326 into the base piece 314. In accordance with embodiments, threading the clamp assembly 312 and spindle assembly 320 toward one another causes the distal end of the spindle assembly (e.g. the doubly threaded fastener 326*a*) to drive the drive piece 316 toward a distal end of the clamp assembly 312.

The clamp assembly 310 may include a clamp hood 312 and a drive piece 316 that is axially translatable within the clamp hood 312. The drive piece 316 may fit inside the diameters of the base piece 314. For example, a proximal outside diameter of the drive piece 316 may fit within the proximal inside (threaded) diameter of the base piece 314, and the distal outside diameter of the drive piece 314 may fit within the distal outside (threaded) diameter of the base piece 314. An internal lip or ledge inside the clamp hood 312 may allow the distal diameter of the drive piece 314 to sit inside the base piece 314. Thus, the drive piece 314 may fit within the drive piece 314 and clamp hood 312, and otherwise be freely movable, axially translatable, and not fixed in location. In an embodiment, the base piece 314 is threadably fixed to the clamp hood 312. Thus, while it is possible to be removed, the two pieces remain in fixed locations relative to one another in use.

The jump rope handles 200 in accordance with embodiments may include a spindle housing 332 around the spindle assembly and the one or more bearings 324*a*, 324*b*. An outer race (illustrated as the outer ring) for each of the one or more bearings 324*a*, 324*b* is joined to an interior diameter of the spindle housing 332, and the shaft 322 is joined to an inner race (illustrated as the inner ring) for each of the one or more bearings 324*a*, 324*b* such that the shaft 322 is rotatable relative to the spindle housing 332.

In accordance with embodiments, a collar 328 may be fixed onto the doubly threaded fastener 326*a* such that rotation of the collar 328 causes rotation of the shaft 322. The collar 328 in accordance with embodiments may be the intermediary component that aids the user in threading and unthreading the clamp assembly 310, and hence, securing and releasing the jump rope from the handle 200. In an embodiment, the collar 328 is fixed onto an intermediate location of the doubly threaded fastener 326*a*. For example, the collar 328 may be fixed with an interference fit, adhesive, or otherwise. The collar 328 may be permanently fixed in place such that the collar 328 and doubly threaded fastener 326*a* rotate in unison. Similarly, the proximal end of the doubly threaded fastener 326*a* may be fixed to the shaft 322 (e.g. threaded into an inside diameter of the shaft), such that they remain permanently attached and rotate in unison during operation. The outside proximal threads of the doubly threaded fastener 326*a* and inside threads of the shaft 322 are mated such that the collar 328 is fixed onto the doubly threaded fastener with a gap (e.g. air gap) between a proximal end of the collar 328 and a distal end of the spindle housing 332 such that the collar 328 does not rub or otherwise interfere with the spinning of the spindle assembly 320. Thus, the collar 328 and spindle housing 332 are permanently spaced apart during use. In accordance with embodiments, the collar may have a textured outer surface. For example, the textured outer surface may have an average surface roughness greater suitable to aid gripping with a user's fingers. In an embodiment, the outer surface of the collar has an average surface roughness greater than that of the spindle housing 332 or grip 336 (or a wider pattern on the surface). As previously described, rotation of the collar 328 and the clamp hood 312 in opposite rotation directions with regard to each other causes axial translation of the doubly threaded fastener 326*a* within the base piece 314.

Referring now to FIGS. 4-5, in some embodiments the jump rope handle 200 is configured for an adjustable side rope connection. In the illustrated embodiments, laterally opposite holes 402 may be formed in the clamp hood 312, with the hole sizes configured to accommodate a jump rope. In the particular embodiment illustrated in FIG. 4, the doubly threaded fastener 326*a* is axially translatable within the base piece 314 to drive a distal face 340 of the drive piece 316 from a location proximal to the pair of laterally opposite holes 402 to a location laterally adjacent to (or past) the pair of laterally opposite holes 402. In use, the drive piece 316 can be translated to press orthogonally against a rope spanning between two holes 402 in the clamp assembly to secure a length of the jump rope within the clamp assembly.

Referring now to the embodiment illustrated in FIG. 5, a dual use jump rope handle 200 is illustrated combining features from the jump rope handles of both FIG. 3 and FIG. 4. As shown, the clamp assembly including a pair of laterally opposite holes 402 additionally includes a set of jaws 318 within the clamp hood 312 distal to the drive piece 316. In such an embodiment, the jaws 318 may be used to secure a rope axially, or though the side. In an embodiment, the fastener 326*a* is axially translatable within the base piece 314 to cause the drive piece 316 to drive the jaws 318 within the clamp hood 312 from a location proximal to the pair of laterally opposite holes 402 to a location laterally adjacent to (or past) the pair of laterally opposite holes 402 to secure a length of the jump rope within the clamp assembly. As previously described, the set of jaws 318 may be translatable along a tapered bore of the clamp hood 312, where the set of jaws 318 closes as the set of jaws is translated distally along the tapered bore of the clamp hood. Similar to FIG. 2, a lumen 202 may extend from a distal end of the clamp assembly in FIG. 5, through a distal end of the spindle assembly, with the lumen configured to accommodate an end portion of the jump rope.

The jump ropes 201 in accordance with embodiments described herein can be any of a number of different ropes, cables, cords, wires, lines, laces, or the like suitable for demands of play, exercise, training, or sport with the jump rope system 100. For example, the jump rope 201 can be a bare or polymer-coated wire cable (e.g., nylon-coated wire cable or polytetrafluoroethylene-coated wire cable) or an entirely polymer-based cable (e.g., polyvinyl chloride-based cable). The jump rope 201 can have a diameter that ranges from, for example, 1 mm to 4 mm.

A jump rope system including at least one jump rope (e.g., the jump rope 201) and a pair of jump rope handles (e.g., each jump rope handle of the pair of jump rope handles being the jump rope handle 200) can be packaged or otherwise provided in a package or kit. The package can be designed for an activity such as play, exercise, training, or sport, or the package can be designed for a combination of the foregoing activities. Accordingly, the package can further include a spare jump rope identical to the at least one jump rope for a same type of activity, or the package can include a second jump rope different from the at least one jump rope for a different type of activity. For example, the at least one jump rope can be for exercise or training while the second jump rope can be for tricks during play. Any one or more of the jump ropes can be provided in a standard length (e.g., 10 feet) for a one-time adjustment, if needed, before clamping the jump rope in the clamping assemblies of the pair of jump rope handles. Information such as instructions or tips for using the jump rope system can also be included in the package. Such information can include tips for appropriate jump rope lengths for different activities.

Components of the clamp assembly 310 such as the clamp hood 312, components of the spindle assembly 320 such as the spindle shaft 322 and the collar 328, and components of the housing assembly 330 such as the spindle housing 332 and the end piece 334 can be machined from a metal or alloy including aluminum, titanium, or stainless steel. Alternatively, one or more of such components can be molded from a high-density polymer such as high-density polyethylene ("HDPE") or a composite such as a fiber-reinforced polymer (e.g., carbon fiber-reinforced polymer). Other components of the clamp assembly 310 and the spindle assembly 320 can be fashioned from any of a number of metals or alloys including, but not limited to, iron, steel, stainless steel, or zinc alloy as appropriate. For example, the set of jaws 318 can be a high-strength zinc alloy. The grip 336 can be molded from polyvinyl chloride.

While some particular embodiments have been provided herein, and while the particular embodiments have been provided in some detail, it is not the intention for the particular embodiments to limit the scope of the concepts presented herein. Additional adaptations and/or modifications can appear to those of ordinary skill in the art, and, in broader aspects, these adaptations and/or modifications are encompassed as well. Accordingly, departures may be made from the particular embodiments provided herein without departing from the scope of the concepts provided herein.

What is claimed is:

1. A jump rope handle comprising:

a spindle assembly including a shaft coupled to one or more bearings, and a fastener joined to a distal end of the shaft; and a clamp assembly threadably joined to a distal end portion of the spindle assembly, the clamp assembly including a clamp hood, a drive piece that is axially translatable within the clamp hood, and a base piece, wherein the base piece is threadably connected to the distal end portion of the spindle assembly such that threading the clamp assembly toward the spindle assembly causes the distal end portion of the spindle assembly to drive the drive piece toward a distal end of the clamp assembly;

wherein the base piece is threadably joined to the fastener such that threading the fastener into the base piece drives the drive piece toward the distal end of the clamp assembly.

2. The jump rope handle of claim 1, further comprising a spindle housing around the shaft and the one or more bearings, wherein an outer race for each of the one or more bearings is joined to an interior diameter of the spindle housing, and the shaft is joined to an inner race for each of the one or more bearings such that the shaft is rotatable relative to the spindle housing.

3. The jump rope handle of claim 2, wherein the base piece is threadably fixed to the clamp hood.

4. The jump rope handle of claim 1, further comprising a lumen extending from the distal end of the clamp assembly, through the distal end portion of the spindle assembly, the lumen configured to accommodate an end portion of a jump rope.

5. The jump rope handle of claim 1, further comprising a collar fixed onto the fastener, such that rotation of the collar causes rotation of the shaft.

6. The jump rope handle of claim 5, further comprising a spindle housing around the spindle assembly and the one or more bearings, wherein the shaft is rotatable relative to the spindle housing.

7. The jump rope handle of claim 6, wherein the collar is fixed onto the fastener with a gap between a proximal end of the collar and a distal end of the spindle housing.

8. The jump rope handle of claim 7, wherein the collar includes a textured outer surface.

9. The jump rope handle of claim 8, wherein rotation of the collar and clamp hood in opposite rotational directions with regard to each other causes axial translation of the fastener within the base piece.

10. A jump rope handle comprising:

a spindle assembly including a shaft coupled to one or more bearings;

a clamp assembly threadably joined to a distal end portion of the spindle assembly, the clamp assembly including a clamp hood, a drive piece that is axially translatable within the clamp hood, and a base piece, wherein the base piece is threadably connected to the distal end portion of the spindle assembly such that threading the clamp assembly toward the spindle assembly causes the distal end portion of the spindle assembly to drive the drive piece toward a distal end of the clamp assembly; and a pair of laterally opposite holes in the clamp hood, the pair of laterally opposite holes configured to accommodate a jump rope.

11. The jump rope handle of claim 10, wherein the fastener is axially translatable within the base piece to drive a distal face of the drive piece from a location proximal to the pair of laterally opposite holes to a location laterally adjacent to the pair of laterally opposite holes.

12. The jump rope handle of claim 10, wherein the clamp assembly further comprises a set of jaws within the clamp hood distal to the drive piece.

13. The jump rope handle of claim 12, wherein the fastener is axially translatable within the base piece to cause the drive piece to drive a distal portion of the set of jaws from a location proximal to the pair of laterally opposite holes to a location laterally adjacent to the pair of laterally opposite holes.

14. The jump rope handle of claim 13, wherein the set of jaws is translatable along a tapered bore of the clamp hood, wherein the set of jaws closes as the set of jaws is translated distally along the tapered bore of the clamp hood.

15. The jump rope handle of claim 14, further comprising a lumen extending from the distal end of the clamp assembly, through the distal end portion of the spindle assembly, the lumen configured to accommodate an end portion of a jump rope.

16. A jump rope system comprising:

a jump rope; and a pair of jump rope handles, each jump rope handle comprising:

a spindle assembly including a shaft coupled to one or more bearings; and a clamp assembly threadably joined to a distal end portion of the spindle assembly, the clamp assembly including a clamp hood, a drive piece that is axially translatable within the clamp hood, and a base piece, wherein the base piece is threadably connected to the distal end portion of the spindle assembly such that threading the clamp assembly toward the spindle assembly causes the distal end portion of the spindle assembly to drive the drive piece toward a distal end of the clamp assembly; and a pair of laterally opposite holes in the clamp hood, the pair of laterally opposite holes configured to accommodate the jump rope.

17. The jump rope system of claim 16, wherein the distal end portion of the spindle assembly comprises a fastener joined to a distal end of the shaft and the base piece is threadably joined to the fastener such that threading the fastener into the base piece drives the drive piece toward the distal end of the clamp assembly.

18. The jump rope system of claim 16, wherein the distal end portion of the spindle assembly is axially translatable within the base piece to drive a distal face of the drive piece from a location proximal to the pair of laterally opposite holes to a location laterally adjacent to the pair of laterally opposite holes to secure a length of the jump rope within the clamp assembly.

19. The jump rope system of claim 16, wherein the clamp assembly further comprises a set of jaws within the clamp hood distal to the drive piece, wherein the distal end portion of the spindle assembly is axially translatable within the base piece to cause the drive piece to drive a distal portion of the jaws from a location proximal to the pair of laterally opposite holes to a location laterally adjacent to the pair of laterally opposite holes to secure a length of the jump rope within the clamp assembly.

20. The jump rope system of claim 19, further comprising a lumen extending from the distal end of the clamp assembly, through the distal end portion of the spindle assembly, the lumen configured to accommodate an end portion of the jump rope.

* * * * *